United States Patent [19]

Nitto et al.

[11] 4,437,905

[45] Mar. 20, 1984

[54] PROCESS FOR CONTINUOUSLY ANNEALING A COLD-ROLLED LOW CARBON STEEL STRIP

[75] Inventors: Hajime Nitto; Hiromitsu Naitoh, both of Kitakyushu, Japan

[73] Assignee: Nippon Steel Corporation, Tokyo, Japan

[21] Appl. No.: 339,053

[22] Filed: Jan. 13, 1982

Related U.S. Application Data

[63] Continuation-in-part of Ser. No. 139,275, Apr. 10, 1980, abandoned.

[30] Foreign Application Priority Data

Dec. 5, 1979 [JP] Japan ..... 54-156844
Dec. 5, 1979 [JP] Japan ..... 54-156845

[51] Int. Cl.[3] ..... C21D 1/48

[52] U.S. Cl. ..... 148/16; 148/12.1; 148/151

[58] Field of Search ..... 148/13, 14, 12.1, 16, 148/20.3, 151; 134/19

[56] References Cited

U.S. PATENT DOCUMENTS

| | | | |
|---|---|---|---|
| 1,144,884 | 6/1915 | White | 148/16 |
| 2,287,467 | 6/1942 | Carpenter et al. | 148/16 |
| 2,529,689 | 11/1950 | Hess | 148/16 |
| 3,320,085 | 5/1967 | Turner | 134/15 |
| 3,939,013 | 2/1976 | Gardner et al. | 148/12.1 |
| 4,140,552 | 2/1979 | Arnold et al. | 148/16 |

FOREIGN PATENT DOCUMENTS

| | | |
|---|---|---|
| 52-144331 | 12/1977 | Japan . |
| 53-17518 | 2/1978 | Japan . |

*Primary Examiner*—John P. Sheehan
*Attorney, Agent, or Firm*—Wenderoth, Lind & Ponack

[57] ABSTRACT

A cold-rolled low carbon steel strip is continuously annealed by rapidly heating the steel strip with a gaseous combustion product which has been prepared at a combustion air ratio of 0.8 or more but less than 1.0 in a direct fired furnace to a temperature of 500° C. to an $Ac_3$ point of the steel strip at an average heating rate of 30° to 100° C./sec to cause the thickness of a layer of oxides produced on the peripheral surface of the steel strip not to exceed 1,000 angstroms; by maintaining the temperature of the rapidly heated steel strip in a range of from 700° C. to the $Ac_3$ point, in a reducing atmosphere comprising 4% or more of hydrogen and the balance nitrogen, for at least 10 seconds, to reduce the oxide layer; by cooling the steel strip from at least 600° C. to a desired temperature, at an average cooling rate of 10° to 300° C./sec by using a cooling medium comprising a gas and a liquid; and by eliminating an oxide layer formed on the peripheral surface of the steel strip during the cooling procedure.

11 Claims, 2 Drawing Figures

PROCESS FOR CONTINUOUSLY ANNEALING A COLD-ROLLED LOW CARBON STEEL STRIP

This application is a continuation-in-part of our copending application Ser. No. 139,275, filed on Apr. 10, 1980, and now abandoned.

FIELD OF THE INVENTION

The present invention relates to a process for continuously annealing a cold-rolled low carbon steel strip. More particularly, the present invention relates to a process for continuously annealing a cold-rolled low carbon steep strip, which process is capable of completing the annealing operation within a short time and, also, capable of obtaining at a low cost a cold-rolled steel strip having an excellent workability, especially, formability, and an excellent surface quality.

The process of the present invention can be applied to not only ordinary cold-rolled low carbon steel strips, but also, high tensile strength cold-rolled low carbon steel strips.

BACKGROUND OF THE INVENTION

It is known that a cold-rolled steel strip having a high drawing quality can be produced by tightly or loosely coiling a cold-rolled steel strip and, then, by annealing it batchwise in a box type annealing furnace. This type of method needs several days to complete the entire process thereof and, therefore, is extremely inefficient. In order to avoid the above-mentioned disadvantage, various attempts have been made to continuously carry out the annealing process, and some of the attempts have been practicably used in industry.

The continuous annealing method can exhibit an extremely high efficiency in comparison with the conventional batch type annealing method. However, it is strongly desired to increase the efficiency of the continuous annealing method to such an extent that the continuous annealing operation is completed within a few minutes.

In a known continuous annealing process, a steel strip is heated in a reducing atmosphere. In this case, the heating operation is effected by using an electric heater or a radiation heating tube in which a fuel is burnt. However, this indirect heating of the steel strip by the radiation heating tube causes the heating rate and heat efficiency to be poor, and also, requires a large heating device and a long time to complete the annealing operation.

In order to accelerate the continuous annealing operation, it has been attempted to rapidly heat the steel strip by using a direct fired furnace or to rapidly cool the heated steel strip with water or a mixture of gas and water in the initial stage of the cooling operation. Such a rapid heating method also allows elimination of an electrolytic cleaning operation before the rapid heating operation. However, both the rapid heating operation and the rapid cooling operation in the above-mentioned processes cause an oxide layer to be formed on the peripheral surface of the steel strip. Therefore, it is necessary to eliminate the oxide layer from the annealed steel strip. Examples of the accelerated continuous annealing methods are as follows.

(1) Japanese Patent Application Laying-open (Kokai) No. 52-14431 (1977) discloses an annealing process in which a steel strip is rapidly heated to a predetermined temperature and maintained at the temperature in a direct fired furnace and, then, rapidly cooled with water, reheated, overaged and, finally, subjected to an acid pickling operation to remove an oxide layer formed on the peripheral surface of the steel strip.

(2) Japanese Patent Application Laying-open (Kokai) No. 53-17518 (1978) discloses a process wherein a steel strip is rapidly heated to a predetermined temperature and maintained at the temperature in the direct fired furnace, rapidly cooled with water and, overaged while the oxide layer on the peripheral surface thereof is removed by reducing it.

Especially, in the above-mentioned process (1) the heating and cooling operations result in the formation of a considerably large thickness of the oxide layer, and this large thickness causes the time necessary for completing the elimination of the oxide layer to be undesirably long. Also, in the process (1), in order to overage the steel strip after the rapid cooling, it is necessary to reheat the steel strip to an overaging temperature thereof.

In the above-mentioned process (2), the elimination of the oxide layer from the steel strip is carried out by the overaging operation at a relatively low temperature. Therefore, in order to effectively attain the elimination of the oxide layer, the reducing operation should be carried out by using a strictly controlled reducing atmosphere having a special concentration of hydrogen and a specified dew point.

Usually, the cold-rolled low carbon steel strip is subjected, after the annealing operation, to a surface processing, for example, metal plating or coating. Accordingly, it is necessary that, after the annealing operation, the steel strip have a clean peripheral surface suitable for the surface processing.

When an oxide layer having a too large thickness is formed on the peripheral surface of the steel strip during the annealing process, this oxide causes the surface layer to become porous even after the oxide layer is completely reduced. This porous surface exhibits poor surface processing properties, that is, a poor activity of accepting various chemical treatments, a poor binding property to a coating, a poor resistance to corrosion even after the surface-processing and a poor plating property.

For example, U.S. Pat. No. 4,140,552 discloses a method for the treatment of an aluminium-killed and low alloy steel strip and sheet surface in a sulfur-bearing atmosphere. In this method, the steel strip is heated to a temperature of from 427° C. to 705° C. in a gaseous combustion product atmosphere from a fuel containing sulfur, to form a sulfur and oxygen rich film on the surface of the steel strip. The sulfur and oxygen-containing film is reduced in a reducing atmosphere containing at least 10% of hydrogen gas and having a dew point of 20° C. or less.

However, the reduction of the sulfur-and-oxygen-containing film on the surface of the steel strip results in the formation of a reduced porous layer. Such a steel strip having a porous surface layer is usable for the hot galvanizing process, but is useless for the electroplating process.

Japanese Patent Application Laid-open No. 53-17518 (1978) discloses a process for annealing a steel strip. In this process, a steel strip is preheated to a temperature of 300° to 400° C. in an exhaust gas containing oxygen; the preheated steel strip is heated in a direct fired furnace, in which a fuel is burnt at a combustion air ratio of 0.9 to 1.0, to a temperature of 700° to 750° C. and maintained at this temperature for a predetermined time period; the heated steel strip is cooled and then overaged at a temperature of 400° to 500° C. in a reducing atmosphere, while causing an oxide layer on the steel strip surface to be reduced and eliminated.

However, in this process, the thickness of the oxide layer formed on the surface of the steel strip is undesirably large. That is, in order to completely reduce the oxide layer, it is necessary that the steel strip stay in the reducing atmosphere for a long time period, even if the concentration of the hydrogen gas in the reducing atmosphere is increased. Also, even if the reduction of the oxide layer is completed, the resultant surface layer of the steel strip is porous, and, therefore, is not suitable for the electroplating process.

Accordingly, it is strongly desired to be able to effect the continuous annealing process to the cold-rolled low carbon steel strip without forming a thick oxide layer on the peripheral surface of the steel strip, and to be able to easily eliminate the oxide layer from the steel strip.

SUMMARY OF THE INVENTION

An object of the present invention is to provide a process for continuously annealing a cold-rolled low carbon steel strip to produce an annealed steel strip having a peripheral surface thereof suitable for various surface processings.

Another object of the present invention is to provide a process for continuously annealing a cold-rolled low carbon steel strip without forming a thick layer of oxides on the peripheral surface of the steel strip.

Still another object of the present invention is to provide a process for continuously annealing a cold-rolled low carbon steel strip within a short time.

The above-mentioned objects can be attained by the process of the present invention, which comprises the continuous steps of:

introducing a cold-rolled low carbon steel strip into a direct fired furnace, in which a fuel is burnt in a combustion air ratio of 0.8 or more but less than 1.0 to produce a gaseous combustion product, and in which furnace the steel strip is heated in the gaseous combustion product atmosphere at an average heating rate of from 30° to 100° C./second in the temperature range of from 500° C. to the $Ac_3$ point of the steel strip, whereby the thickness of the layer of oxides formed on the peripheral surface of the steel strip is limited to 1,000 angstroms or less;

introducing the heated steel strip into a reducing atmosphere which comprises a mixture of 4% or more of hydrogen gas and the balance consisting of nitrogen gas and which has a dew point of 10° C. or less and in which atmosphere the temperature of the steel strip is maintained in the range of from 700° C. to the $Ac_3$ point of the steel strip for 10 seconds or more, whereby the layer of oxides is reduced;

cooling the reduced steel strip to a desired temperature in such a manner that the cooling operation is started from a temperature of at least 600° C. of the steel strip and carried out at an average cooling rate of from 10° to 300° C./second by bringing a cooling medium, consisting of a mixture of a gas and a liquid, into contact with the steel strip; and subjecting the cooled steel strip to a treatment for eliminating a layer of oxides which has been formed on the peripheral surface of the steel strip during the cooling operation.

The "combustion air ratio" as used above and throughout the Specification is understood in the art to mean the ratio of the amount of air in volume supplied to combust a predetermined amount of fuel to the amount of air in volume stoichiometrically necessary for completely burning the predetermined amount of fuel.

In the process of the present invention, the cooling operation may or may not be followed by an overaging operation, depending on the properties of the steel strip to be annealed. That is, in the cases of steel strips having a non-aging property, for example, extremely low carbon steel strips and steel strips containing at least one member selected from Ti, V, Nb and B, and having very small contents of carbon and nitrogen each in the form of a solid solution, the overaging operating can be omitted. However, in the cases of usual cold-rolled low carbon steel strips having an aging property, the overaging operation is usually applied to them in order to precipitate carbon, which is in the state of an oversaturated solid solution, from the steel strip by the cooling operation. In this case, the cooling operation may be terminated when the temperature of the steel strip reaches a level near an overaging temperature of the steel strip, the cooled steel strip may be overaged and, then, the overaged steel strip may be additionally cooled to a desired temperature.

DETAILED DESCRIPTION OF THE INVENTION

Figure 1:
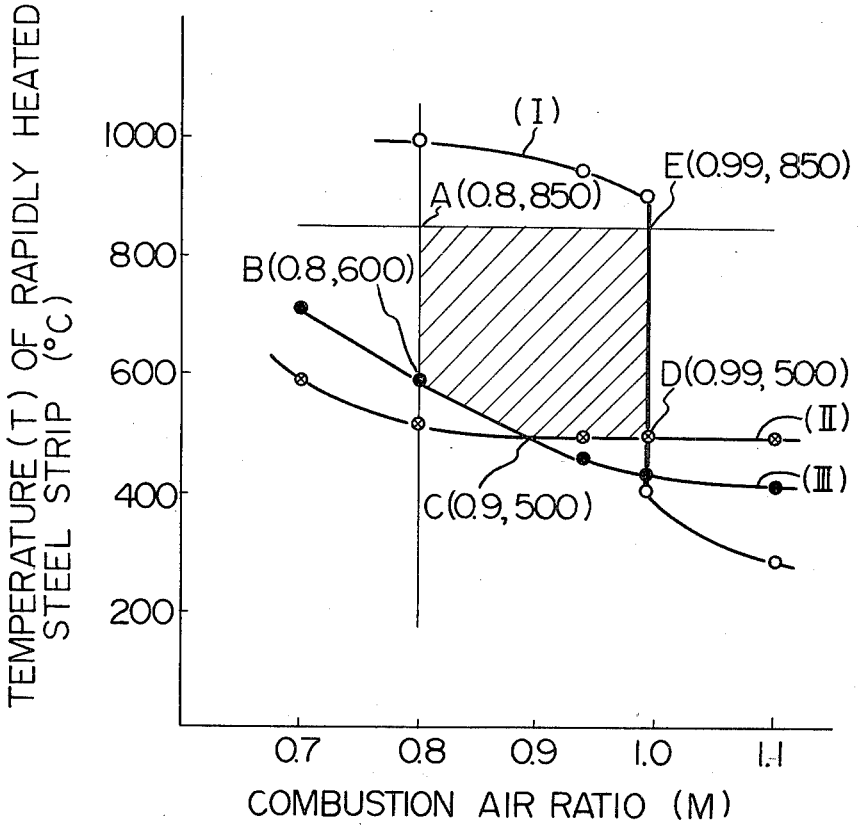
FIG. 1 is a rectangular co-ordinate diagram showing the relationship between a combustion air ratio in a direct fired furnace and a temperature up to which a steel strip is rapidly heated in the direct fired furnace, in the process of the present invention.

The process of the present invention can be applied to cold-rolled non-aging low carbon steel strips, for example, cold-rolled, extremely low carbon aluminium-killed steel strips, and cold-rolled non- or retarded-aging extremely low carbon steel strips containing a small amount of Ti, Nb, V or B, which are capable of forming a carbo-nitride compound. In other words, the process of the present invention can be applied to various cold-rolled low carbon steel strips which include the usual type of cold-rolled low carbon steel strip having a drawing quality and a deep drawing quality, for example, bodies of automobiles, high tensile strength cold-rolled low carbon steel strips and other types of cold-rolled low carbon steel strips suitable for various surface-treating processes, for example, metal plating and coating processes. Before applying the process of the present invention, the peripheral surface of the cold-rolled steel strip may be cleaned to remove grease or rolling oil therefrom by a conventional surface-cleaning method. However, the process of the present invention may be applied to the cold-rolled steel strip without surface-cleaning it.

In the process of the present invention, a cold-rolled steel strip is continuously introduced into a direct fired furnace in which the steel strip is brought into direct contact with a gaseous combustion product, so as to cause the temperature of the steel strip to be rapidly elevated to a desired level in a range of from 500° C. to an $Ac_3$ point of the steel strip and, also, the thickness of a layer of oxides formed on the peripheral surface of the steel strip is to not exceed 1,000 angstroms. That is, it is important that the steel strip be directly heated with the gaseous combustion product consisting of a combustion gas which has been generated by burning a mixture of a fuel with air at a combustion air ratio of 0.8 or more but less than 1.0 in the direct fired furnace. This feature can cause the steel strip to rapidly reach a desired temperature in a range of from 500° C. to an $Ac_3$ point of the steel strip. Also, the gaseous combustion product causes the layer of oxides formed on the peripheral surface of the steel strip not to exceed the thickness of 1,000 angstroms.

It is known that, sometimes, the oxide layer can not be completely reduced by the reducing operation conducted at a temperature and for a period of time which are usual, from the point of view of metallurgy.

The oxide layer produced by a rapid heating operation appears black and exhibits an excellent heat-absorbing property. Therefore, the oxide layer is effective for rapidly heating the steel strip with a high efficiency. In the process of the present invention, the above-mentioned effect of the oxide layer is advantageously utilized. Also, when the oxide layer has a thickness not exceeding 1,000 angstroms, it is possible to completely reduce the oxide layer by a reducing operation, and the resultant steel strip has a peripheral surface thereof which exhibits an excellent activity to various surface treatments, an excellent bonding property to various surface treating material, for example, plated metal layer and coatings, an excellent resistance to corrosion after surface treatment and a proper luster.

Even if the rapid heating operation is followed by the reducing operation for removing the oxide layer, if the thickness of the oxide layer does exceed 1,000 angstroms, it is difficult to completely remove the oxide layer by a short time reducing operation. In this regard, even if the reducing operation is carried out over an unusually long period of time, the reduced oxides form a porous layer on the steel strip surface.

The incompletely reduced oxide layer and the porous layer cause the surface property of the resultant steel strip to be poor. For example, when a steel strip having an incompletely reduced oxide layer or a porous layer formed on its peripheral surface, is subjected to a surface treatment with a surface treating agent, for example, zinc phosphate, the resultant treated surface is uneven, coarse or delustered. Also, the incompletely reduced surface exhibits a poor bonding property to a plated metal layer or coating layer.

In order to limit the thickness of the oxide layer to a low level of 1,000 angstroms or less, it is necessary to rapidly heat the steel strip to a desired temperature, within a very short time, with the gaseous combustion product generated in a direct fired furnace. In this connection, it should be noted that the thickness of the oxide layer is variable, depending on the temperature up to which the steel strip is rapidly heated and the combustion air ratio at which the gaseous combustion product is generated from a mixture of fuel and air. It was found by the inventors of the present invention that the thickness of the oxide layer can be controlled by controlling both the temperature up to which the steel strip is rapidly heated and the combustion air ratio.

FIG. 1 is a rectangular co-ordinate diagram showing the relationship between the temperature of the rapidly heated steel sheet and the combustion air ratio.

Referring to FIG. 1, it was found by the inventors of the present invention that, when a steel strip is rapidly heated under conditions corresponding to a region on or below Curve (I), the resultant oxide layer exhibits a thickness not exceeding 1,000 angstroms. The rapid heating operation was carried out at a heating rate of from 30° C./second to 100° C./second. Usually, it is difficult to effect the rapid heating operation at a heating rate of more than 100° C./second in the direct fired furnace. Also, when the rapid heating operation is carried out at a heating rate of less than 30° C./second, it is difficult to obtain an oxide layer having a thickness not exceeding 1,000 angstroms. Also, in the case where a cold-rolled steel strip is directly subjected to the rapid heating operation without a pre-surface cleaning operation, in order to decrease the amount of iron powder remaining on the peripheral surface of the steel strip after the rapid heating operation, to an extent substantially equal to that of a pre-surface cleaned steel strip after the rapid heating operation, it is preferable that the rapid heating operation be carried out under conditions corresponding to a region on or above Curve (II) in FIG. 1. Furthermore, when the pre-surface cleaning operation is omitted, in order to remove grease or rolling oil on the peripheral surface of the steel strip to an extent substantially identical to that of the pre-surface cleaned steel strip, it is preferable that the rapid heating operation be carried out under conditions corresponding to the region on or above Curve (III) in FIG. 1.

Moreover, from a point of view of fuel economy, it is preferable that the combustion air ratio be more than 0.8. A combustion air ratio less than 0.8 causes the content of non-burnt fuel in the combustion gas to be 20% or more.

In addition, the temperature up to which the steel strip is rapidly heated and at which the steel strip is recrystallized, is preferably in a range of from 500° to 850° C.

Accordingly, referring to FIG. 1, it is preferable that the gaseous combustion product be generated by the combustion of a fuel at a combustion air ratio (M) and that the steel strip reach a temperature (T) in the direct fired furnace, which ratio (M) and temperature (T) fall on or within an irregular pentagon, in a rectangular co-ordinate diagram, defined by the co-ordinates A, B, C, D and E,

A(M:0.8, T:850)

B(M:0.8, T:600)

C(M:0.9, T:500)

D(M:0.99, T:500) and

E(M:0.99, T:850).

When the steel strip is rapidly heated under the conditions corresponding to the region on or in the pentagon ABCDE in FIG. 1, the combustion air ratio may be varied depending on the temperature of the steel strip in the direct fired furnace. This method is referred to as "an inclined combustion method". The inclined combustion method is effective for reducing the thickness of the oxide layer.

In connection with the combustion air ratio, it should be understood that a gaseous combustion product generated in a practical direct fired furnace at a combustion air ratio of 0.45 or 0.5 or more, which is variable depending on the type of fuel, exhibits an oxidizing property. That is, even if a fuel is burnt at a combustion air ratio less than 1.0, in practice, the resultant gaseous combustion product contains a small amount of non-burnt free molecular oxygen. The free molecular oxygen contained in the gaseous combustion product in the direct fired furnace contributes to the oxidation of the surface layer of the steel strip. The content of the free molecular oxygen in the gaseous combustion product is substantially proportional to the combustion air ratio. Therefore, the larger the combustion air ratio, the thicker the resultant oxide layer. Also, in a predetermined combustion air ratio, the higher the heating temperature, the thicker the resultant oxide layer.

As stated above, in the case where a combustion of a fuel is carried out at a combustion air ratio of 1.0 or less, theoretically, the resultant gaseous combustion product contains no free oxygen. However, in a practical combustion condition, the resultant gaseous combustion product contains a very small amount of free oxygen.

In the process of the present invention, the steel strip is introduced into the gaseous combustion product atmosphere generated in the direct fired furnace at a combustion air ratio of 0.8 or more, but less than 1.0, and rapidly heated to a desired temperature, irrelevant to the presence or absence of the free oxygen in the gaseous combustion product.

When the gaseous combustion product produced at a combustion air ratio of less than 1.0 contains the free oxygen, the surface of the steel strip is oxidized. Also, it is well-known that even in the case where the gaseous combustion product contains no free oxygen, the surface of the strip is oxidized with $CO_2$ and $H_2O$ contained in the gaseous combustion product. The intensity of oxidation is variable, depending on the ratio $H_2O/H_2$, which is a ratio of the concentration of $H_2O$ to the concentration of $H_2$, and on the ratio $CO_2/CO$, which is a ratio of the concentration of $CO_2$ to the concentration of CO in the gaseous combustion product, and the temperature of the steel strip.

Figure 2:
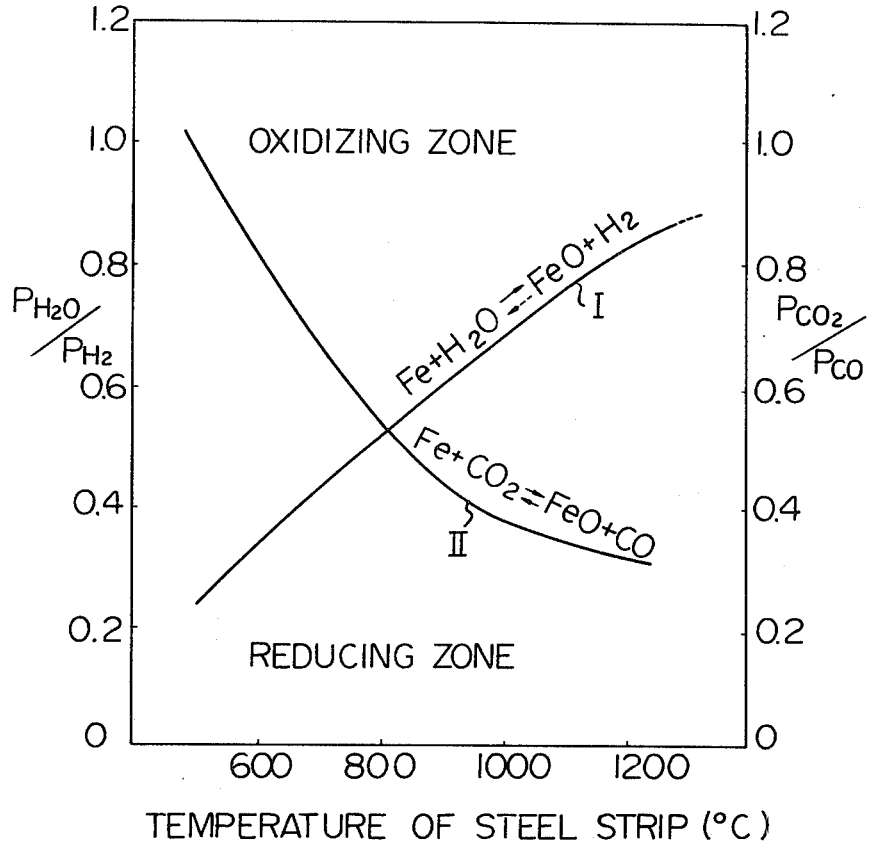
FIG. 2 is a graph showing the relationship between the oxidation and reduction of a steel strip and the temperature of the steel strip and the ratio $PH_2O/PH_2$ and the ratio $PCO_2/PCO$. The terms $PH_2O$, $PH_2$, $PCO_2$ and PCO will be defined hereinafter.

FIG. 2 shows an equilibrium diagram for the oxidation and reduction of a steel strip in an atmosphere containing $H_2O$, $H_2$, $CO_2$ and CO. That is, FIG. 2 shows a relationship in the oxidation and reduction of a steel strip, of the temperature of the steel strip and the ratio $PH_2O/PH_2$, in which $PH_2O$ represents a partial pressure of $H_2O$ and $PH_2$ represents a partial pressure of $H_2$ in a gaseous combustion product and the ratio $PCO_2/PCO$ in which $PCO_2$ represents a partial pressure of $CO_2$ and PCO represents a partial pressure of CO in the gaseous combustion product.

The oxidation and reduction of the steel strip due to $H_2O$ and $CO_2$, and $H_2$ and CO are carried out, respectively, as follows.

$$Fe + H_2O \rightleftharpoons FeO + H_2 \text{ and}$$

$$Fe + CO_2 \rightleftharpoons FeO + CO$$

Referring to FIG. 2, the steel strip is oxidized in the zone above Curve (I) due to the reaction of iron with $H_2O$ and in the zone above Curve (II) due to the reaction of iron with $CO_2$. Also, the steel strip is reduced in the zone below Curve (I) due to the reaction of iron oxide with $H_2O$ and in the zone below Curve (II) due to the reaction of iron oxide with CO.

That is, the intensities of the oxidation and reduction of the steel strip are variable, depending on the temperature of the steel strip, and the ratio $PH_2O/PH_2$ and the ratio $PCO_2/PCO$ in the gaseous combustion product.

A reactivity of a steel strip with a gaseous combustion product produced at a combustion air ratio of 0.8 or more, but less than 1.0, was investigated at a temperature of from 500° C. to the $Ac_3$ point of the steel strip, as follows.

A coke furnace gas, having a composition indicated in Table 1, was burnt with air which contained 5% water vapor at a combustion air ratio indicated in Table 2. The resultant gaseous combustion product exhibited a combustion temperature, a ratio $H_2O/H_2$ and a ratio $CO_2/CO$ shown in Table 2.

TABLE 1

| Composition of Coke Furnace Gas (% by volume) | | | | | | | |
|---|---|---|---|---|---|---|---|
| Component | $CH_4$ | $C_2H_4$ | $CO_2$ | CO | $H_2$ | $N_2$ | $H_2O$ |
| Amount | 28.0 | 3.6 | 2.3 | 6.3 | 56.7 | 2.8 | 0.0 |

TABLE 2

| Combustion temperature (°C.) | Ratio $H_2O/H_2$ | | | Ratio $CO_2/CO$ | | |
|---|---|---|---|---|---|---|
| | Combustion air ratio | | | | | |
| | 0.8 | 0.9 | 0.99 | 0.8 | 0.9 | 0.99 |
| 527 | 2.79 | 4.83 | 13.78 | 11.86 | 20.50 | 30.00 |
| 627 | 2.54 | 4.96 | 13.83 | 5.64 | 11.29 | 39.50 |
| 728 | 2.73 | 5.36 | 15.69 | 3.89 | 7.60 | 19.25 |
| 827 | 2.97 | 5.83 | 16.80 | 2.88 | 5.62 | 15.20 |
| 927 | 3.20 | 6.21 | 18.07 | 2.24 | 4.38 | 12.50 |

In view of Table 2 and FIG. 2, it is realized that, when the gaseous combustion product is produced at a combustion air ratio of from 0.8 to 0.99 and has a temperature of from 527° to 927° C., the gaseous combustion product falls in the iron-oxidizing zone in FIG. 2.

As mentioned above, in the case where the coke furnace gas is burnt at a combustion air ratio of 8.0 or more, but less than 1.0, and the steel strip is heated to a temperature not exceeding the $Ac_3$ point of the steel strip, the gaseous combustion product is oxidative to the steel strip, even if no free oxygen is contained in the gaseous combustion product. This phenomenon is true even if the coke furnace gas is replaced by another gaseous fuel, for example, a blast furnace gas, methane gas or propane gas.

Accordingly, when the steel strip is heated in the atmosphere consisting of the above-mentioned type of gaseous combustion product, it is inevitable that the surface of the strip is oxidized. The intensity of oxidation is variable, depending on the heating temperature and the residence time of the steel strip in the direct fired furnace.

In the process of the present invention, the combustion air ratio, the heating temperature of the steel strip and heating rate in the direct fired furnace are regulated respectively to values as specified hereinbefore. This regulation is effective for limiting the thickness of the layer of oxides formed on the surface of the steel strip to a value not exceeding 1,000 angstroms.

Also, it is possible to reduce the thickness of the oxide layer by adjusting the combustion air ratio in a downstream portion of the direct fired furnace, in which portion the steel strip exhibits a higher temperature than that in an upstream portion, to a smaller value than that in the upstream portion.

In the rapid heating operation, the cold-rolled steel strip is heated up to a temperature in a range of from 500° C. to an $Ac_3$ point of the steel strip. The rapid heating operation can be effected in any of the following three manners.

(1) The steel strip is heated from room temperature directly to the above-specified temperature range by using a direct fired furnace in which the gaseous combustion product is blown onto the steel strip.

(2) The steel strip is preheated from room temperature to a temperature lower than 500° C. at a low heating rate, by using an exhaust gas discharged from the direct fired furnace, and, then, rapidly heated to the above-specified range of temperature in the direct fired furnace.

(3) The steel strip is rapidly heated to a temperature at which the steel strip is recrystallized, or to a temperature near the recrystallizing temperature, at a high heating rate, in the direct fired furnace and, then, heated to a desired temperature at a reduced heating rate, preferably, in a non-oxidizing atmosphere.

When using any of the above-mentioned three heating manners, it is essential that the heating operation be carried out so as to cause the thickness of the oxide layer not to exceed 1,000 angstroms. It is preferable that the heating operation in at least a temperature range of from 400 to the $Ac_3$ point of the steel strip be carried out at an average heating rate of from 30° to 100° C./second.

If the steel strip is heated in the direct fired furnace by bringing the steel strip into contact with a flame containing 100 ppm or more of unburnt free oxygen, it is necessary to carry out the heating operation at a heating rate of 40° C./second or more. However, in the process of the present invention, since the heating of the steel strip is carried out by using a gaseous combustion product containing free oxygen in an amount not exceeding 100 ppm, usually, close to zero, it is possible to restrict the thickness of the layer of oxides on the surface of the steel strip to 1,000 angstroms or less.

The rapid heated steel strip is introduced into a reducing atmosphere in which the temperature of the steel strip is maintained in a range of from 700° C. to the $Ac_3$ point of the steel strip, preferably, from 700° to 850° C. for 10 seconds or more, more preferably, from 10 to 120 seconds. In this reducing operation, the oxide layer on the peripheral surface of the steel strip is reduced.

It is not necessary to maintain the above-specified reducing temperature constant over the above-mentioned time, as long as the temperature is in the above-specified range. That is, the reducing temperature may be variable in the above-specified range depending on the composition and purpose of the steel sheet, as long as the varied temperature is suitable for the recrystallization of the steel strip and the growth of grains.

In order to rapidly reduce the oxide layer within a time of from 10 to 120 seconds, it is preferable that the reducing atmosphere comprise a mixture of 4% or more of hydrogen gas, with the balance consisting of nitrogen gas, and exhibit a dew point of 10° C. or less.

The reducing operation in which the steel strip is uniformly heated, is effective not only for removing the oxide layer, but also, for preventing a deterioration in the surface property of the steel strip. In the case where a cold-rolled steel strip, especially, one which has not been pre-surface cleaned, is rapidly heated in a direct fired furnace, and then, maintained at a predetermined temperature in a non-reducing atmosphere, sometimes, a portion of the oxide layer is peeled from the peripheral surface of the steel strip and the peeled oxide layer adheres onto a peripheral surface of hearth rollers. The adhered oxide layers on the hearth rollers cause undesirable formation of scratches on the peripheral surface of the steel strip. This is because, since the rapidly heated steel strip is held in the non-reducing atmosphere at a high temperature, the oxide layer is easily peeled from the peripheral surface of the steel strip and sintered on the peripheral surfaces of the hearth rollers and adheres thereonto. However, in the process of the present invention, since the rapidly heated steel strip is held in the reducing atmosphere and, therefore, the oxide layer is reduced therein, the adhesion of the oxide layer onto the hearth rollers can be prevented.

The reduced steel strip is cooled to a desired temperature. The cooling operation can be effected by bringing a cooling medium, consisting of a gas, liquid, for example, boiling water, an atomized liquid or a mixture of a gas and a liquid, into contact with the reduced steel strip.

The cooling operation is preferably carried out rapidly from at least a temperature of 600° C. of the steel strip. That is, the steel strip may be gradually cooled from the uniform heating temperature up to a temperature of 600° C. or more and, then, rapidly cooled to the desired temperature at a cooling rate of from 10° to 300° C./second.

In order to control the cooling rate, it is preferable that the cooling operation be started from a temperature of at least 600° C. of the steel strip and carried out by bringing a cooling medium, consisting of a mixture of a gas and a liquid, into contact with the steel strip. In this case, the liquid is preferably water and the gas is usually selected from inert gases, such as nitrogen gas, and mixtures of nitrogen and hydrogen. In a preferable example, the cooling medium consists of a mixture of nitrogen gas with water.

When the process of the present invention is applied to a cold-rolled low carbon steel strip having an aging property, the cooling operation is terminated when the temperature of the steel strip reaches a level near an overaging temperature of the steel strip, the cooled steel strip is overaged and, then, additionally cooled to a desired temperature.

The overaging operation is carried out for the purpose of depositing carbon from the steel strip, which has been saturated with carbon in the state of a solid solution. The overaging operation is preferably carried out in a temperature range of from 300° to 550° C., more preferably, from 350° to 450° C., for 3 minutes or less, more preferably, 2 minutes or less. It is not always necessary that the steel strip be maintained at a constant temperature throughout the overaging operation. That is, a overaging temperature in an initial stage of the overaging operation may be higher than that in a final stage of the overaging operation.

After the overaging operation, the steel strip is cooled from the overaging temperature to a desired temperature, usually, room temperature.

When the cooling medium contains water in any of the states of liquid, mist and steam, the peripheral surface of the steel strip cannot be prevented from oxidation. That is, the resultant layer of oxides causes the appearance of the steel strip surface to be unsatisfactory, and the surface property of the steel strip to be unsuitable to the surface treatments. Therefore, it is necessary to eliminate the layer of oxides from the peripheral surface of the steel strip.

The elimination of the oxide layer can be effected by any conventional chemical and physical methods effective for eliminating various oxides. For example, the oxide layer can be removed by treating the peripheral surface of the steel strip with an acid aqueous solution, for example, an acid aqueous solution of an inorganic acid, such as hydrochloric acid, sulfuric acid or phosphoric acid, or of an organic acid, such as formic acid or oxalic acid. The treatment may be effected by immersing the steel strip in an acid aqueous solution, by spraying the acid aqueous solution onto a peripheral surface of the steel strip, or by subjecting the steel strip to an electrolytic pickling with an acid aqueous solution.

In the process of the present invention, the oxide layer formed in the cooling and, optionally, overaging operation, is very thin. Therefore, the oxide layer can be readily eliminated by the above-mentioned methods. After the cleaning operation is completed, the acid-cleaned steel strip is washed with water. However, since the peripheral surface of the acid-cleaned steel strip is reactive to oxygen, and easily rusts, it is preferable that the water-washed steel strip be neutralized with a diluted alkali aqueous solution. This neutralization is effective for preventing rust and discoloration of the peripheral surface of the steel strip.

Usually, the cold-rolled steel strip, for example, to be used for producing a body of an automobile, is coated before the working process. In this case, the steel strip is surface treated with zinc phosphate. The quality of the zinc phosphate film formed on the surface of the steel strip can be improved by applying the following treatment to the steel strip after the acid-cleaning operation.

That is, as a surface pre-treatment, an aqueous suspension containing water-insoluble phosphate, for example, $Zn_3(PO_4)_2$, is sprayed onto the surface of the acid-cleaned steel strip, or a thin film of Ni, Zn or Mn is flash-coated on the acid-cleaned steel strip surface by means of electroplating. Thereafter, as a pre-coating operation, the steel strip is surface treated with the zinc phosphate. The above-mentioned surface pre-treatment is effective for promoting the formation of crystal nucleuses of the zinc phosphate and for providing a dense film of the zinc phosphate. Therefore, the above-mentioned surface pre-treatment is very effective for enhancing the bonding strength of the zinc phosphate layer to the coating layer and for increasing the resistance of the coating layer to corrosion.

The surface pre-treatment with the aqueous suspension of the water-insoluble phosphate, may be carried out for the steel strip which has been acid-cleaned and washed with water, but not neutralized. In this case, the surface pre-treatment is also effective for neutralizing the acid-cleaned steel strip. The surface pre-treatment with the water-insoluble phosphate may be carried out on the acid-cleaned steel strip after it has been washed with water neutralizing it and then, again washing it with water. Otherwise, the aqueous suspension of the water-insoluble phosphate may be mixed with a skin finishing liquid, and when the steel strip is subjected to a skin pass operation, the mixture may be sprayed onto the steel strip surface.

The process of the present invention can exhibit the following advantages.

(1) Since the thickness of the oxide layer produced by the rapid heating operation is very small and the oxide layer can be completely reduced by the reducing operation, the resultant steel strip has a very clean, non-oxidized peripheral surface. Even if a layer of oxides is generated by the cooling operation, the oxide layer is very thin, and therefore, can be readily eliminated by an easy acid-cleaning operation.

(2) Since the heating operation and cooling operation can be effected at a high speed of the steel strip, the annealing time is remarkably shortened.

(3) Since the steel strip is held in a reducing atmosphere, substantially no oxide layer adheres to the hearth rollers in the reducing atmosphere.

(4) By utilizing the cooling operation with a mixture of a gas and a liquid, the cooliing rate of the steel strip can be easily controlled. For example, the steel strip can be easily cooled to a temperature close to the overaging temperature of the steel strip. Therefore, the overaging operation can be directly applied to the cooled steel strip without heating the cooled steel strip to the overaging temperature.

The following specific examples are presented for the purpose of clarifying the present invention. However, it should be understood that these examples are intended only to illustrate the present invention and are not intended to limit the scope of the present invention in any way.

EXAMPLE 1 AND COMPARATIVE EXAMPLE 1

In Example 1, an extremely low carbon aluminium-killed steel strip, which contained 0.0018% of carbon and had been cold-rolled, was continuously introduced into a direct fired furnace, in which the steel strip was brought into contact with a gaseous combustion product generated at a combustion air ratio of 0.94, so as to cause the temperature of the steel strip to be rapidly elevated to 700° C. at a heating rate of 50° C./second and so as to cause the thickness of the resultant layer of oxides to be 730 angstroms. Next, the rapidly heated steel strip was introduced into a reducing atmosphere which comprised a mixture of 5% of hydrogen gas, with the balance consisting of nitrogen gas, and which had a dew point of −5° C., and in which the temperature of the steel strip was maintained at 850° C. for 40 seconds, so as to cause the oxide layer to be reduced.

Next, the reduced steel strip was cooled in such a manner that, when the steel strip reached a temperature of 700° C., a mixture of water and nitrogen gas was blown toward the steel strip to rapidly cool it to a temperature of 90° C. at a cooling rate of 100° C./second. The cooled steel strip was, then, acid-cleaned with a 2% aqueous solution of hydrochloric acid at a temperature of 90° C. for 2 seconds. The peripheral surface of the acid-cleaned steel strip exhibited a satisfactory appearance.

Finally, the acid-cleaned steel strip was coated with zinc phosphate by a usual method. The layer of the resultant zinc phosphate coating was scratched. Then, an aqueous solution of sodium chloride was sprayed onto the scratched surface of the zinc phosphate coated steel strip and, finally, the strayed steel strip was left standing in the atmosphere for ten days, to test the resistance of the surface of the steel strip to corrosion. The results of the corrosion test revealed that the coated surface of the steel strip exhibited an excellent resistance to corrosion.

In Comparative Example 1, the same procedures as those mentioned in Example 1 were carried out, except for the following items.

In the direct fired furnace, the heating operation was carried out at a heating rate of 30° C./second by bringing the steel strip into a direct contact with a flame generated at a large combustion air ratio of 1.01. Therefore, the resultant layer of oxides exhibited a large thickness of 4,300 angstroms.

After the acid-cleaning operation, the peripheral surface of the resultant steel strip was stained with scale or had a porous layer.

After the coating operation with the zinc phosphate, the coated surface of the steel strip was extremely corroded by the corrosion test.

EXAMPLE 2 AND COMPARATIVE EXAMPLE 2

In Example 2, the same procedures as those described in Example 1 were carried out, except for the following items.

A low carbon capped steel containing 0.07% of carbon, which had been cold-rolled, was used.

By the rapid heating operation, the resultant layer of oxides exhibited a thickness of 750 angstroms.

The rapidly heated steel strip stayed in the same reducing atmosphere as that described in Example 1, at a temperature of 700° C., for 20 seconds.

When the reduced steel strip reached a temperature of 650° C., a mixture of nitrogen gas with water was blown toward the steel strip to rapidly cool it to a temperature of 400° C. at a cooling rate of 100° C./second.

Thereafter, the steel strip was overaged in a nitrogen gas atmosphere, at a temperature of 400° C., for 90 seconds.

After the acid-cleaning operation, the resultant steel strip had a satisfactory peripheral surface.

Also, it was found that the corrosion test resulted in substantially no corrosion of the coated surface of the steel strip.

In Comparative Example 2, the same procedures as those described in Example 2 were carried out, except for the following points.

In the direct fired furnace, the flame was generated at a large combustion air ratio of 1.01, and the heating rate was 30° C./second. The resultant oxide layer exhibited large thickness of 4,500 angstroms.

After the acid-cleaning operation, the peripheral surface of the resulting steel strip was stained with scale and had a porous layer.

Also, the corrosion test resulted in the surface of the steel strip being significantly corroded.

We claim:

1. A process for continuously annealing a cold-rolled low carbon steel strip, comprising the continuous steps of:

introducing a cold-rolled low carbon steel strip into a direct fired furnace, in which a fuel is burnt in a combustion air ratio of 0.8 or more, but less than 1.0 to produce a gaseous combustion product, and in which furnace said steel strip is heated in said gaseous combustion product atmosphere at an average heating rate of from 30° to 100° C./second in the temperature range of from 500° C. to the $Ac_3$ point of said steel strip, whereby a layer of oxides is formed on the surface of said steel strip, said oxides having a thickness limited to 1,000 angstroms or less;

introducing said heated steel strip into a reducing atmosphere which consists essentially of a mixture of 4% or more of hydrogen gas and the balance consisting of nitrogen gas and which has a dew point of 10° C. or less and in which atmosphere the temperature of said steel strip is maintained in the range of from 700° C. to the $Ac_3$ point of said steel strip for 10 seconds or more, whereby said layer of oxides is reduced;

cooling said reduced steel strip to a desired temperature in such a manner that the cooling operation is started from a temperature of at least 600° C. of said steel strip and carried out at an average cooling rate of from 10° to 300° C./second by bringing a cooling medium, consisting of a mixture of a gas and a liquid, into contact with said steel strip; and subjecting said cooled steel strip to a treatment for eliminating a layer of oxides which has been formed on the surface of said steel strip during said cooling operation;

wherein said air combustion ratio refers to the ratio of the amount of air in volume supplied to combust a predetermined amount of fuel to the amount of air in volume stoichiometrically necessary for completely burning the predetermined amount of fuel.

2. A process as claimed in claim 1, wherein said cold-rolled steel strip is preheated to a temperature of 500° C. or less before being placed in contact with said gaseous combustion product.

3. A process as claimed in claim 1, wherein, in said direct fired furnace, said steel strip reaches a temperature of from 500° to 850° C.

4. A process as claimed in claim 1, wherein, in said direct fired furnace, said gaseous combustion product is generated by the combustion of a fuel at a combustion air ratio (M), and said steel strip reaches a temperature (T), which ratio (M) and temperature (T) fall on or within an irregular pentagon, in a rectangular co-ordinate diagram, defined by the co-ordinates A, B, C, D and E,

A (M:0.8, T:850)

B (M:0.8, T:600)

C (M:0.9, T:500)

D (M:0.99, T:500) and

E (M:0.99, T:850).

5. A process as claimed in claim 2, wherein said preheating operation is carried out by using exhaust gas discharged from said direct fired furnace.

6. A process as claimed in claim 1, wherein said gas in said cooling medium is selected from the group consisting of nitrogen, and mixtures of nitrogen and hydrogen.

7. A process as claimed in claim 1, wherein said liquid in said cooling medium is water.

8. A process as claimed in claim 1, wherein said cooling operation is terminated when the temperature of said steel strip reaches a level near an overaging temperature of said steel strip, said cooled steel strip is overaged and, then, said overaged steel strip is additionally cooled to a desired temperature.

9. A process as claimed in claim 8, wherein said overaging operation is carried out in a temperature range of from 300° to 550° C. for 3 minutes or less.

10. A process as claimed in claim 9, wherein said overaging operation is carried out in a temperature range of from 350° to 450° C.

11. A process as claimed in claim 1, wherein said oxide-eliminating treatment is carried out by using a aqueous solution containing at least one acid selected from the group consisting of hydrochloric acid, sulfuric acid, phosphoric acid, formic acid and oxalic acid.

* * * * *